US005952771A

United States Patent [19]

Zhang

[11] Patent Number: 5,952,771

[45] Date of Patent: Sep. 14, 1999

[54] MICROPOINT SWITCH FOR USE WITH FIELD EMISSION DISPLAY AND METHOD FOR MAKING SAME

[75] Inventor: Tianhong Zhang, Boise, Id.

[73] Assignee: Micron Technology, Inc., Boise, Id.

[21] Appl. No.: 08/779,590

[22] Filed: Jan. 7, 1997

[51] Int. Cl.[6] ..... H01J 1/02

[52] U.S. Cl. ..... 313/309; 313/336; 313/351

[58] Field of Search ..... 313/309, 336, 313/351, 445

[56] References Cited

U.S. PATENT DOCUMENTS

| | | | |
|---|---|---|---|
| 3,814,968 | 6/1974 | Nathanson et al. | 313/95 |
| 3,970,887 | 7/1976 | Smith et al. | 313/309 |
| 3,999,209 | 12/1976 | Wrigley et al. | 357/23 |
| 4,042,946 | 8/1977 | Sokoloski | 357/25 |
| 4,748,131 | 5/1988 | Zietlow | 437/24 |
| 5,024,722 | 6/1991 | Cathey, Jr. | 156/643 |
| 5,210,472 | 5/1993 | Casper et al. | 315/349 |
| 5,212,426 | 5/1993 | Kane | 315/169.1 |
| 5,219,773 | 6/1993 | Dunn | 437/42 |
| 5,229,331 | 7/1993 | Doan et al. | 437/228 |
| 5,329,207 | 7/1994 | Cathey et al. | 315/169 |
| 5,344,525 | 9/1994 | Cathey, Jr. | 156/643 |
| 5,354,698 | 10/1994 | Cathey, Jr. | 437/20 |
| 5,357,172 | 10/1994 | Lee et al. | 315/167 |
| 5,358,908 | 10/1994 | Reinberg et al. | 437/228 |
| 5,372,973 | 12/1994 | Doan et al. | 437/228 |
| 5,374,868 | 12/1994 | Tjaden et al. | 313/310 |
| 5,387,844 | 2/1995 | Browning | 315/169 |
| 5,391,259 | 2/1995 | Cathey et al. | 156/643 |
| 5,410,218 | 4/1995 | Hush | 315/169.1 |

OTHER PUBLICATIONS

Claeys, C., Simoen, E., Vanhellemont J., "Radiation Hardening Studies of Silicon Technologies for Space Applications" *Electron Technology,* 27, 3/4, pp. 23–42 Warszawa 1994.

Dunn, G.J., Jayaraman, R., Yang, W., and Sodini, C.G., "Radiation effects in low pressure reoxidized oxide gate dielectrics", *Appl. Phys, Lett.* 52 (20), pp. 1713–1715, May 1988.

Lai, C., Lei, T., et al. "Post–Polysilicon Gate–Process–Induced Degradation on Thin Gate Oxide", *IEEE Electron Device Letters,* vol. 16, No. 11, Nov. 1995.

Viju, M.K., Maddox, R., Fazan, P. et al., "Degradation of Junction Leakage in Devices Subjected to Gate Oxidation in Nitrous Oxide", *IEEE Electron Device Letters,* vol. 13, No. 12, Dec. 1992.

Takashi, H., and Iwasaki, H., "Improved Hot–Carrier Immunity in Submicrometer MOSFET's with Reoxidized Nitrided Oxides Prepared by Rapid Thermal Processing", *IEEE Electron Device Letters,* vol. 10, No. 2, Feb. 1989, pp. 64–66.

Winokur, P.S., Sexton, F.W., Schwank, J.R., Fleetwood, D.M., Dressendorfer, P.V., Wrobel, T.F., and Turpin, D.C., "Total–Dose Radiation and Annealing Studies Implications for Hardness Assurance Testing", *IEEE Transactions on Nuclear Science,* vol. NS–33, No. 6, Dec. 1986, pp. 1343–1351.

*Primary Examiner*—Vip Patel
*Attorney, Agent, or Firm*—Hale and Dorr LLP

[57] ABSTRACT

A micropoint assembly is disclosed that includes a micropoint and a switch coupled to the micropoint. The switch is operable to activate and deactivate the micropoint and includes a nitride oxidation layer. The switch may be a MOSFET with a gate oxide that contains the nitride oxidation layer. In such configuration, the nitride oxidation layer contains the greatest concentration of SiN within the gate oxide. A method for constructing the micropoint assembly and field emission displays incorporating the micropoint assembly is also disclosed. Such method includes simultaneous annealing of the nitride oxidation layer during conventional FED fabrication steps.

31 Claims, 8 Drawing Sheets

MICROPOINT SWITCH FOR USE WITH FIELD EMISSION DISPLAY AND METHOD FOR MAKING SAME

GOVERNMENT RIGHTS

This invention was made with Government support under Contract No. DABT63-93-C-0025 awarded by the Advanced Research Projects Agency ("ARPA"). The Government has certain rights in this invention.

BACKGROUND OF THE INVENTION

The present invention relates to a method and apparatus for reducing the detrimental effects of energy generated within a field emission device ("FED") and especially as related to micropoint switches.

FED technology has recently core into favor as a technology for developing low power, flat panel displays. This technology uses an array of cold cathode emitters and cathodoluminescent phosphors for conversion of energy from an electron beam into visible light. Part of the desire to use FED technology for flat-panel displays is that such technology is conducive to producing flat screen displays having high performance, low power and light weight.

Referring to FIG. 1, a representative cross-section of a prior art FED 100 is shown generally. As is well known, FED technology operates on the principal of cathodoluminescent phosphors being exited by cold cathode field emission electrons. The general structure of a FED includes silicon substrate or baseplate 102 onto which a thin conductive structure is disposed. Silicon baseplate 102 may be a single crystal silicon layer. Alternatively, substrate or baseplate 102 may be constructed from one or more semiconductor layers or structures that include active or operable portions of semiconductor devices.

The thin conductive structure may be formed from doped polycrystalline silicon or metal that is deposited on baseplate 102 in a conventional manner. This thin conductive structure serves as the emitter electrode. The thin conductive structure is usually deposited on baseplate 102 in strips that are electrically connected. (Alternatively, the emitter electrode may be formed from the implantation of ions into baseplate 102.) In FIG. 1, a cross-section of strips 104, 106, and 108 is shown. The number of strips for a particular device will depend on the size and desired operation of the FED.

At predetermined sites on the respective emitter electrode strips, spaced apart patterns of micropoints are formed. (Micropoints are also referred to as "field emission cathodes," "field emitters" or "emitters.") In FIG. 1, micropoint 110 is shown on strip 104, micropoints 112, 114, 116, and 118 are shown on strip 106, and micropoint 120 is shown on strip 108. With regard to the patterns of micropoints on strip 106, a square pattern of 16 micropoints, which includes micropoints 112, 114, 116, and 118, may be positioned at that location. However, it is understood that one or a pattern of more than one micropoint may be located at any one site.

Preferably, each micropoint resembles a cone. The forming and sharpening of each micropoint is carried out in a known manner such as disclosed in U.S. Pat. Nos. 3,970,887, 5,372,973 and 5,391,259, each of which is hereby incorporated by reference in its entirety for all purposes. The micropoints may be constructed of a number of materials, such as single crystal silicon. Moreover, to ensure the optimal performance of the micropoints, the tips of the micropoints can be coated or treated with a low work function material.

Although not shown in FIG. 1, micropoints 110–120 are typically controlled (i.e., activated into an emitting state or deactivated into a non-emitting state) by switches (typically transistors) disposed within or proximate to baseplate 102. Examples of such switches, referred to herein as "micropoint switches," are provided in U.S. Patent Nos. 5,212,426, 5,357,172, 5,387,844 and 5,410,218, each of which is hereby incorporated by reference in its entirety for all purposes.

After forming the emitter electrode, dielectric insulating layer 122 is deposited over emitter electrode strips 104, 106, and 108, and the patterned micropoints located at predetermined sites on the strips. The insulating layer may be made from a variety of materials including silicon dioxide ($SiO_2$), spin-on-glass or borophosphosilicate glass.

A conductive layer is disposed over insulation layer 122. This conductive layer forms extraction structure 132 which is a low potential anode used to extract electrons from the micropoints. Extraction structure 132 may be made from a variety of conductive materials including chromium, molybdenum, doped polysilicon or silicided polysilicon. Extraction structure 132 may be formed as a continuous layer or as parallel strips. If parallel strips form extraction structure 132, it is referred to as an extraction grid, and the strips are disposed perpendicular to emitter electrode strips 104, 106 and 108 thereby forming the rows of a matrix structure. Whether a continuous layer or strips are used, once either is positioned on the insulating layer, they are appropriately etched by conventional methods to surround but be spaced away from the micropoints.

At each intersection of the extraction and emitter electrode strips or at desired locations along emitter electrode steps when a continuous extraction structure is used, a micropoint or pattern of micropoints are disposed on the emitter strip. Each micropoint or pattern of micropoints serve as the cathode of the FED and illuminate one pixel of the screen display.

Once the lower portion of the FED is formed, faceplate 140 is fixed a predetermined distance above the top surface of the extraction structure 132. Typically, this distance is several hundred micrometers. This distance is maintained by spacers formed by conventional methods. Representative spacers 136 and 138 are shown in FIG. 1.

Faceplate 140 is a cathodoluminescent screen that is constructed from clear glass or other suitable material. A conductive material, such as indium tin oxide ("ITO") is disposed on the surface of the glass facing the extraction structure. ITO layer 142 serves as the anode of the FED. A high vacuum is maintained in area 134 between faceplate 140 and baseplate 102.

Black matrix 149 is disposed on this surface of the ITO layer 142 facing extraction structure 132. Black matrix 149 defines the discrete pixel areas for the screen display of the FED. Phosphor material is disposed on ITO layer 142 in the appropriate areas defined by black matrix 149. Representative phosphor material areas that define pixels are shown at 144, 146 and 148. These pixels are aligned with the openings in extraction structure 132 so that a micropoint or group of micropoints that are meant to excite phosphor material are aligned with that pixel. Zinc oxide is a suitable material for the phosphor material since it can be excited by low energy electrons.

A FED has one or more voltage sources that maintain emitter electrode strips 104, 106 and 108, extraction structure 132, and ITO layer 142 at three different potentials for proper operation of the FED. Emitter electrode strips 104, 106 and 108 are at "−" potential, extraction structure 132 is at a "+" potential, and the ITO layer 142 at a "++" potential. When such an electrical relationship is used, extraction structure 132 will pull an electron emission stream from micropoints 110, 112, 114, 116, 118 and 120. Thereafter, ITO layer 142 will attract the freed electrons.

The electron emission streams that emanate from the tips of the micropoints fan out conically from their respective tips. Some of the electrons strike the phosphors at 90° to the faceplate while others strike it at various acute angles. The contrast and brightness of the screen display of the FED are optimized when the emitted electrons strike or impinge upon the phosphors at 90°.

The cathodoluminescent screen of a FED is typically illuminated through the use of a matrix addressable array of micropoints, as is well known to those having ordinary skill in the art. In such a configuration, the FED incorporates a column signal to activate a column switching driver and a row signal to activate a row switching driver. At the intersection of both an activated column and an activated row, a voltage differential between an extraction structure and micropoint exists sufficient to induce a field emission, thereby causing illumination of the associated phosphor of a pixel on the cathodoluminescent screen. Such matrix addressable arrays are illustrated in U.S. Pat. Nos. 5,210,472 and 5,410,218, both of which are hereby incorporated by reference in their entirety for all purposes.

The foregoing voltage differential is achieved through the use of a micropoint switch. An example of such a switch is provided in FIG. 2A, which is a reproduction of FIG. 2 of U.S. Pat. No. 5,357,172. As described below, when a micropoint switch is turned on, associated micropoint(s) are activated; i.e., kept at a sufficiently low voltage to achieve the necessary voltage differential so to induce a field emission. FIG. 2A schematically shows a micropoint assembly 200 disposed adjacent to extraction structure 132. Assembly 200 includes micropoint switches 206, 208 which are coupled to micropoints 114–118.

Referring to FIG. 2A, extraction structure 132 is continuous throughout a FED array and is maintained at a constant potential. Base electrode 202 is insulated from extraction structure 132 and is common to micropoints 114–118. Although FIG. 2A shows only three micropoints common to base electrode 202, this number is typically higher in conventional FEDs.

In order to induce field emission, base electrode 202 is grounded through a pair of series-coupled field effect transistors (FETs) 206 ($Q_c$) and 208 ($Q_R$) and current-regulating resistor 210(R). Resistor 210 is interposed between the source of transistor 208 and ground. Transistor 206 is gated by a column line signal $S_c$ while transistor 208 is gated by a row line signal $S_R$. A micropoint is deactivated (i.e., placed in a non-emitting state) by turning off either or both of the series-connected transistors (206 and 208). From the moment that at least one of the transistors is turned off (i.e., the gate voltage $V_{gs}$ drops below the threshold voltage $V_t$ of the transistor), electrons will continue to be discharged from the micropoints corresponding to that transistor until the voltage differential between the base and the extraction structure is just below an emission threshold voltage. Conversely, when both transistor 206 and 208 are turned on (i.e., the gate voltage Vgs applied to each rises above the corresponding device threshold voltage $V_t$), a coupled micropoint is activated resulting in a sufficient voltage differential (between the micropoint and extraction structure 132) to induce a field emission.

FIG. 2B illustrates the composite elements of FETs 206 and 208 in the form of a semiconductor MOSFET structure 220. FETs 206 and 208, in accordance with conventional MOSFET construction, include a gate 211 (made from any conventional substance such as doped polysilicon or metal) disposed over a gate oxide layer 218 made from silicon dioxide. Gate oxide 218 is disposed atop a lightly P+ doped substrate 212. As shown in FIG. 2B, a source region 214 and a drain region 216 are disposed within substrate 212 immediately beneath and to either side of gate oxide 218. These source-drain regions, as is well known in the art, may be formed through a variety of processes, including ion implantation.

Micropoint assembly 200 of FIG. 2A also includes an optional fusible link 204 which may be blown during testing if a base-to-micropoint short exists thereby isolating the micropoints coupled to electrode 202 from the rest of a FED array.

FED operation is, in some respects, similar to a conventional cathode ray tube. Electrons are emitted from a cathode and hit a phosphor covered anode to produce light. The brightness of this light depends on the emission current from cathode to anode. In order to maintain a desired brightness, the voltage difference between the anode and cathode ranges from hundreds to thousands of volts. This voltage difference creates a very large electrical field between the anode and cathode.

During FED operation, the phosphor coated anode emits energy in response to incident electrons emitted from the micropoint emitters. This energy may be referred to as "anode-based energy". Some of this anode-based energy is directed towards the baseplate of the FED and affects the operation of this underlying structure. More specifically, when a micropoint switch is constructed from a MOSFET (such as shown in FIG. 2B) disposed within or proximate to a baseplate, such anode-based energy may effectively lower the threshold voltage of the MOSFET. This lowering of the threshold voltage may cause the MOSFET, and its corresponding micropoint or micropoints, to remain erroneously activated. The relatively small distance separating the anode and cathode of a FED display makes the cathodes of such displays particularly susceptible to such anode-based energy.

Accordingly, it is desirable to provide an improved method and apparatus that reduces the effect of anode-based energy on devices typically disposed within or proximate to a baseplate in a FED cathode.

SUMMARY OF THE INVENTION

The present invention is directed to reducing the effect of anode-based energy on active devices (i.e., switches) typically disposed within or proximate to a baseplate of a FED. In accordance with one embodiment, a micropoint assembly comprises a micropoint and a MOSFET coupled to the micropoint, the MOSFET being operable to activate and deactivate the micropoint. The MOSFET includes a substrate and a nitride oxidation layer disposed adjacent to said substrate.

In accordance with another embodiment, a FED includes a cathodoluminescent screen, a plurality of micropoints disposed proximate to the screen which enable the emission of electrons toward the screen when activated and termination of such emission when deactivated, and a switch coupled to the plurality of micropoints and capable of deactivating the plurality of micropoints. The switch contains a nitride oxidation layer.

In accordance with yet another embodiment of the invention, a method for constructing a micropoint assembly includes the steps of forming a micropoint and forming a switch coupled to the micropoint for activating and deactivating the micropoint. The switch is formed by forming a gate oxide disposed proximate to the micropoint, forming a nitride oxidation layer beneath the gate oxide and annealing the nitride oxidation layer.

The present invention provides for a FED with enhanced protection against the effects of anode-based energy with relatively minor modifications to standard FED architecture and fabrication processes. Active devices (i.e., MOSFET switches) subject to anode-based energy are each modified to more effectively withstand the detrimental effects of such energy. Tests have demonstrated successful operation of such devices in FED environments for prolonged periods of at least 3000 hours for 1,200 Volts between the cathode and anode.

A further understanding of the nature and advantages of the invention may be realized by reference to the remaining portions of the specification and the drawings.

DESCRIPTION OF SPECIFIC EMBODIMENTS

Figure 3:
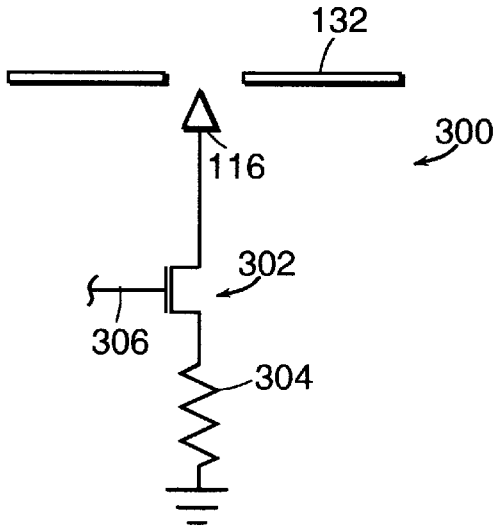
FIG. 3 is a micropoint assembly pursuant to the principles of the present invention.

FIG. 3 discloses a schematic diagram of a first embodiment of a micropoint assembly 300 pursuant to the principles of the present invention. According to this embodiment, micropoint 116 is coupled to the drain of MOSFET 302. The source of this MOSFET is coupled to ground through resistor 304. The gate of MOSFET 302 is coupled to a control signal source S via control line 306. As an alternative configuration, MOSFET 302 may couple micropoint 116 to a current source, and be controlled by a row select signal in accordance with the addressable-array circuits disclosed in U.S. Pat. No. 5,410,218.

In accordance with the present invention, MOSFET 302 is modified so to incorporate a nitride oxidation layer within its gate oxide, which thereby reduces charge trapping capacity in this structure. Nitrogen added to the gate oxide forms strong bonds with silicon and thereby enhances resistance against anode-based energy, so MOSFET 302 may be referred to as an "energy-resistant MOSFET".

Figure 2A:
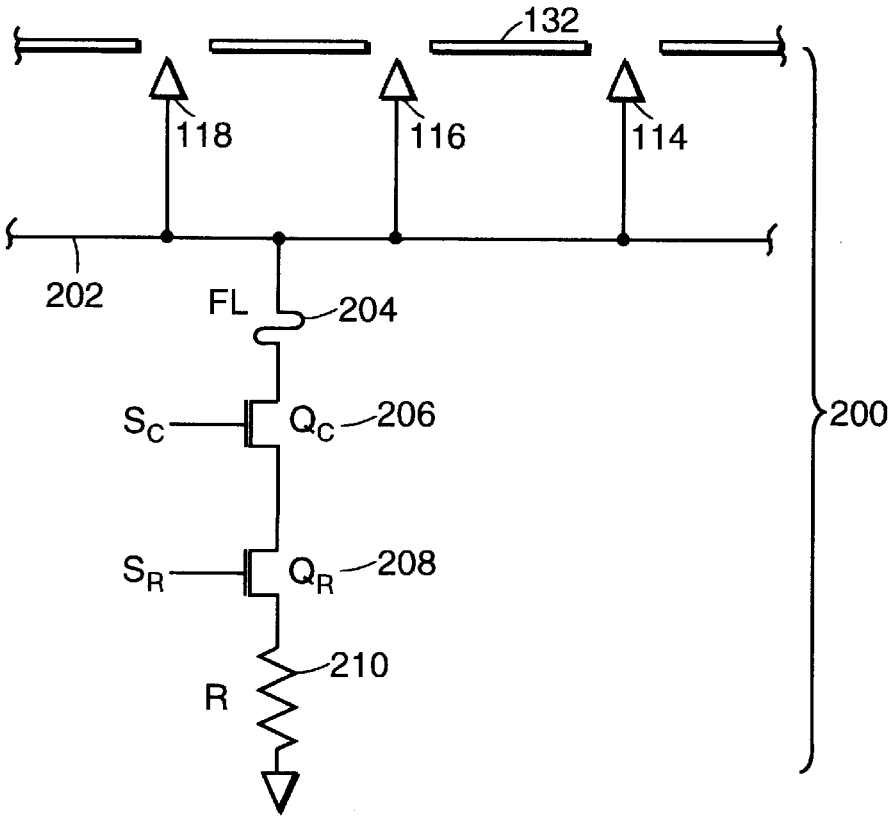
FIG. 2A, which is a reproduction of FIG. 2 in U.S. Pat. No. 5,357,172, is a schematic diagram of micropoint switches coupled to a series of micropoints.
Figure 2B:
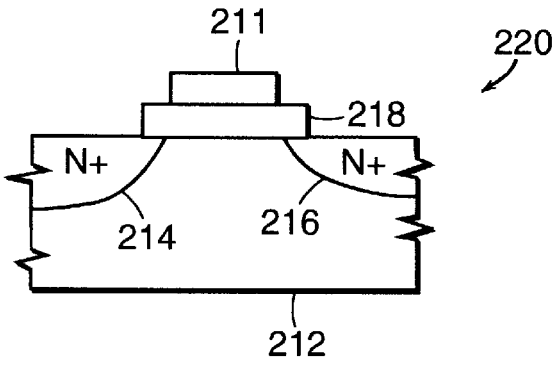
FIG. 2B is a partial cross-sectional view of a conventional semiconductor MOSFET device.

Micropoint assembly 300 provides only one example of a circuit which may be constructed using an energy-resistant MOSFET 302. Any number of variations are possible including, for example, replacing transistors 206 and 208 in the circuit shown in FIG. 2A with two serially-connected, energy-resistant MOSFETs 302.

Figure 4:
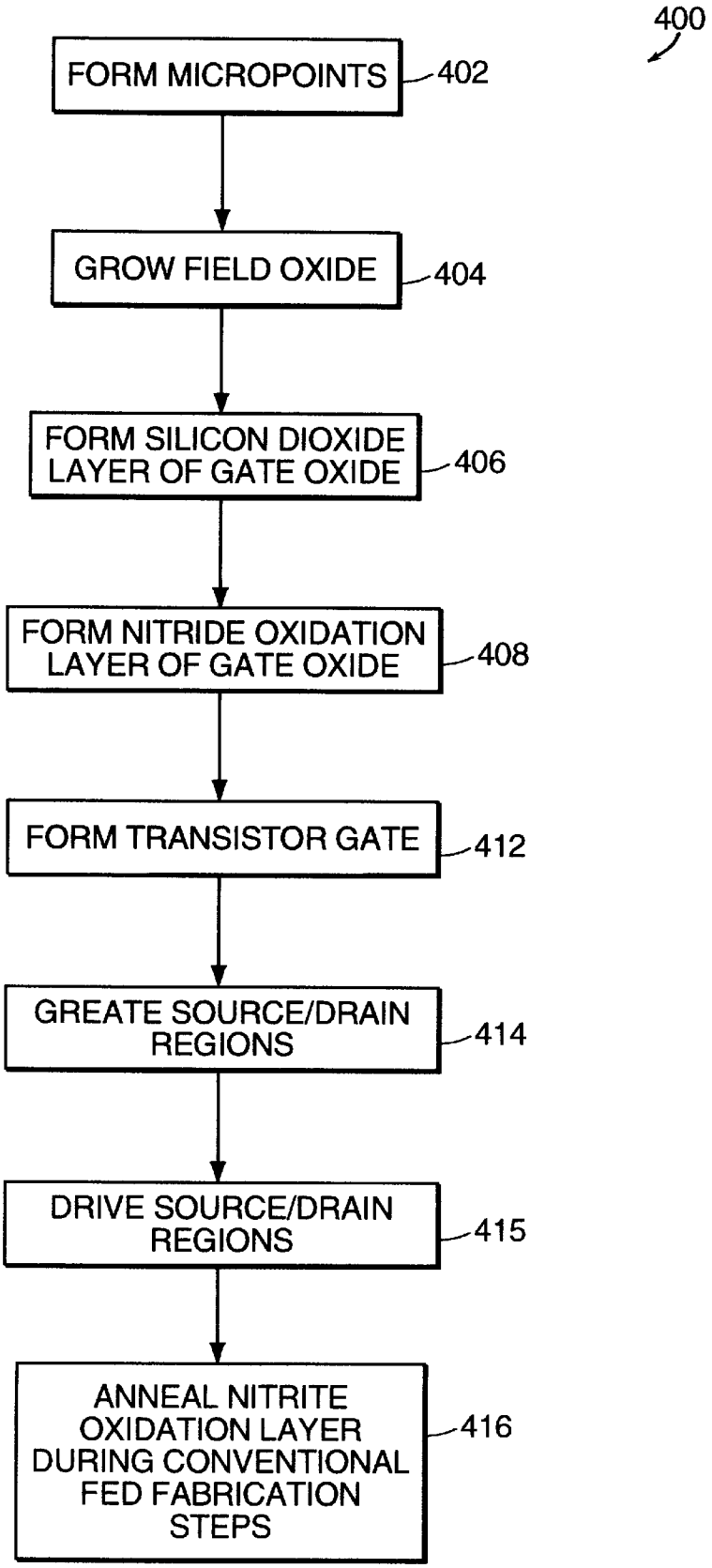
FIG. 4 is a flow chart of a FED fabrication process pursuant to the principles of the present invention.

A method for incorporating energy-resistant MOSFET 302 into an FED structure is illustrated in flow chart 400 of FIG. 4. Structures corresponding to specific steps of this process are illustrated in FIGS. 5A–5D (the structures in these drawings are not drawn to scale). Although these figures show only a single microtip and MOSFET, it would be understood by one having ordinary skill in the art that the following process is intended to be used simultaneously on large volumes of microtips and MOSFETs (forming micropoint assemblies) disposed on one or more conventional semiconductor wafers.

Referring to block 402 of FIG. 4, initially micropoints are formed upon an underlying substrate pursuant to any capable process such as, for example, the processes described in U.S. Pat. Nos. 5,391,259, 5,374,868, 5,372,973, 5,358,908, 5,329,207 and 3,970,887, each of which is hereby incorporated by reference in its entirety for all purposes. Generally, such operation requires the masking and etching of a silicon substrate. This is followed by the formation of N-type connectivity regions for micropoint sites by patterning and doping the silicon substrate (preferably single crystal silicon).

Figure 5A:
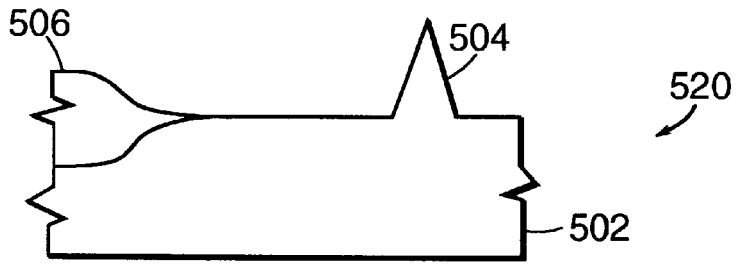
FIGS. 5A–5D and 6 are cross-sectional views depicting several of the basic steps identified in the fabrication process of FIG. 4.

Referring to block 404 of FIG. 4, a suitable oxidation process is then used to sharpen the resulting micropoints as well as grow field oxide within the underlying substrate. The growth of such oxide is well known to those having ordinary skill in the art and may be carried out through any suitable process. Referring to FIG. 5A, field oxide 506 is shown disposed atop and within substrate 502 of semiconductor structure 520. Micropoint 504 is illustrated in its finished state, i.e., with the sharpening oxidation layer removed.

Figure 5B:
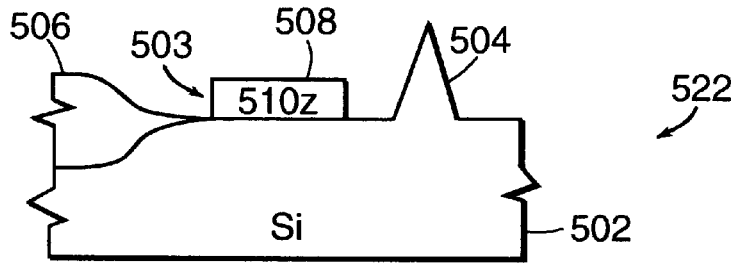

The next step in this process is to grow a gate oxide pursuant to blocks 406 and 408 in FIG. 4. Referring to the preferred parameters set out in Table 1 below, this process requires several operations. First, a silicon dioxide layer is grown in dry $O_2$ in atmospheric pressure (i.e., about 760 Torr) at a temperature of about 957° C. for approximately 18 minutes. Next, this silicon dioxide layer is further grown in dry $O_2$ combined with "Tran 1,2-Dichloroethyline" (i.e., $C_2H_2Cl_2$; referred to herein as "TLC") in atmospheric pressure at a temperature of about 957° C. for about another 18 minutes. As is well known, the addition of TLC during dry oxidation results in significant improvements in the electronic properties of the silicon dioxide. The resulting silicon dioxide layer, such as layer 508 shown in FIG. 5B, is approximately 290 angstroms thick.

Following silicon dioxide layer formation, a nitride oxidation (also referred to as nitrided oxide) layer is grown at the gate-oxide/Si interface 503 of structure 522 (FIG. 5B) pursuant to block 408 in FIG. 4. Referring to Table 1, this process is carried out by heating structure 522 in the presence of $N_2O$ gas at atmospheric pressure. The nitride oxidation process may be carried out preferably in a furnace pursuant to Table 1 or, alternatively, by applying rapid thermal processing (RTP) with a RTP machine (e.g., the Heatpulse 8108 which is available from AG Associates, 4425 Fortran Drive, San Jose, Calif. 95134) pursuant to Table 2. Furnace treatment subjects interface 503 to a temperature of about 957° C. for approximately 100 minutes and yields a nitride oxidation layer of about 30–40 angstroms thick. Alternatively, RTP processing subjects interface 503 to a temperature of about 1000° C. for approximately 120 seconds and yields a nitride oxidation layer of approximately 20 angstroms thick. A nitride oxidation layer 509 disposed at the gate-oxide/Si interface 503 is illustrated in structure 524 of FIG. 5C. Layers 508 and 509 collectively represent gate oxide 514 of the MOSFET being constructed. Accordingly, furnace-based nitride-oxidation formation produces a gate oxide having a thickness of approximately 320–330 angstroms. In contrast, RTP-based formation produces a gate oxide with a thickness of about 310 angstroms. (Tables 1 and 2 represent alternative processes for forming and annealing gate oxide which are identical except for the step of forming a nitride oxidation layer.)

The processing parameters associated with the step of forming a nitride oxidation layer may be altered to accommodate variations in the resulting structure. In a furnace-based process, temperatures may range from about 900° C. to 1100° C. (depending upon oxide thickness) and duration may range from about 20 to 150 minutes (depending upon desired nitrogen concentration). Similarly, in an RTP-based process, temperatures may range from about 950° C. to 1100° C. while duration remains at about 120 seconds. In actual practice, these values are adjusted based on empirical data to determine optimum temperature and time for a particular oxide thickness and nitrogen concentration, respectively.

Although not intended as a limitation of this invention, it believed that hydrogen atoms are stripped from silicon-hydrogen molecules residing within the gate oxide during the process of block 408. The resulting silicon ion is thereafter bonded with a nitrogen atom from the $N_2O$ gas used in this process. This bond is much stronger than the silicon-hydrogen bonds found in the untreated gate oxide and therefore is better able to withstand the affects of anode-based energy. Replacing hydrogen with nitrogen produces a nitride oxidation layer at the gate-oxide/Si interface of the gate oxide which predominantly consists of silicon-nitrogen molecules (SiN). The high-strength nitrogen bonds in these molecules, which serve as a barrier to the effects of high energy electrons (i.e., energy), are subsequently distributed within the interface (i.e., nitride oxidation layer 509) pursuant to an anneal operation discussed below.

When forming the nitride oxidation layer, furnace heating is preferred over RTP heating because the former limits the risk of contamination. Specifically, the silicon dioxide and nitride oxidation layers of the gate oxide may be formed within the same furnace and therefore the subject wafer need not be exposed to air when proceeding from one step to the next. Alternatively, RTP requires silicon dioxide to be grown in a furnace and then moved to a different location in order to carry out the RTP-based nitride oxidation process. This movement potentially exposes the subject wafer to contaminants.

The process used to form nitride oxidation has an unintended effect on the MOSFETs being created. Specifically, the threshold voltage of the devices (i.e., $V_t$) is shifted downward when subjected to either a furnace-based or RTP-based process. The furnace process uniformly shifts the $V_t$ of devices on a single wafer from about 0.6 volts to about 0.2. Conversely, the RTP process shifts the $V_t$ of devices on a single wafer from about 0.6 volts to a range of values; i.e., 0.2 to 0.4 volts. Fortunately, this altered characteristic can be largely corrected through the annealing process, as described below.

After completing silicon dioxide and nitride oxidation layer formation, a transistor gate is formed over gate oxide 514 pursuant to block 412 of FIG. 4. The gate may be made from metal or doped polysilicon pursuant to any conventional gate formation process. An exemplary gate 512 disposed over gate oxide 514 is illustrated in FIG. 5D.

Once gate formation is complete, source/drain regions are formed with N-type dopant (e.g., arsenic or phosphorus) pursuant to block 414. Any conventional doping process may be used such as diffusion or, preferably, ion implantation. Referring to FIG. 5D, an ion implantation process is used to create self-aligned gate 512 and source/drain regions 510. Self alignment is achieved by selecting an implant energy so that the dopant may penetrate any gate oxide left in the source/drain regions but not penetrate gate 512.

After implantation, source/drain regions 510 are driven (i.e., annealed) pursuant to block 415 of FIG. 4. This step is carried out in accordance with conventional MOSFET fabrication techniques. More specifically, structure 526 (FIG. 5D) is heated to a temperature of about 1032° C. in the presence of oxygen gas ($O_2$) flowing at a rate of about 3 standard liters per minute (SLM) for approximately 60 minutes. This step contributes to the removal of disruptions in the silicon lattice caused by ion collisions during implantation.

Figure 1:
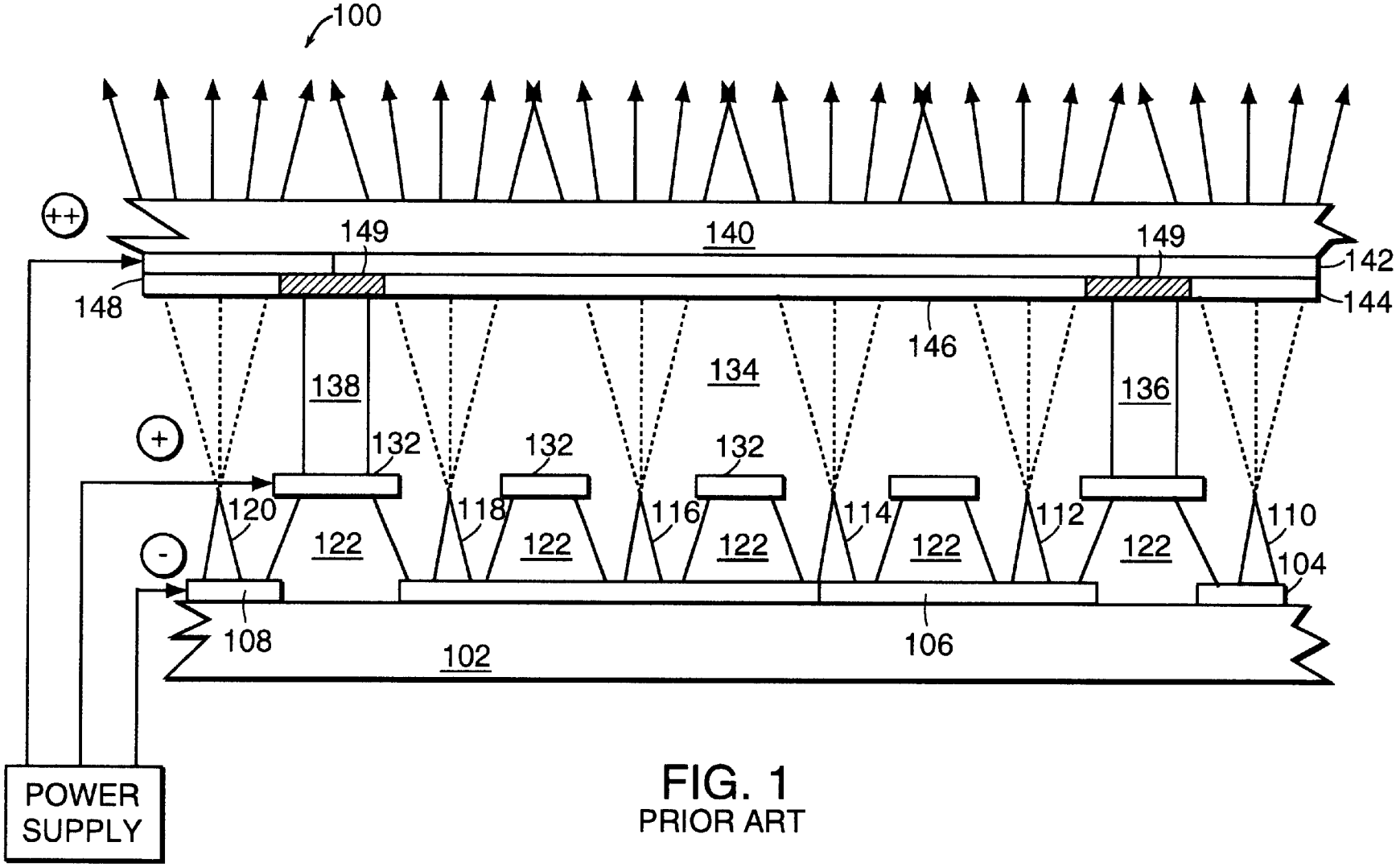
FIG. 1 PRIOR ART
FIG. 1 is a cross-sectional view of a FED as is known in the art.

Referring again to FIG. 4, FED fabrication is then completed pursuant to conventional FED processes in accordance with block 416. These processes include the formation of an insulating layer by conformal deposition of, for example, silicon dioxide over the surface of structure 526. Thereafter, formation of an extraction structure over the insulating layer is carried out by, for example, deposition and doping of polysilicon followed by chemical mechanical planarization, photo-patterning and dry etching. These processes result in the creation of insulating structure 122 and extraction structure 132, respectively, as shown in FIG. 1.

More specifically, formation of the insulating layer through deposition of silicon dioxide is carried out in a low-pressure chemical vapor deposition (LPCVD) reactor by decomposing tetraethylorthosilane (i.e., $Si(C_2H_5O)_4$; also referred to as TEOS). In this conventional process, structure 526 (FIG. 5D) is heated to a temperature of about 710° C. in the presence of silane gas ($SiH_4$) flowing at a rate of about 240 standard cubic centimeters per minute (SCCM) for approximately 24 minutes. This process creates a silicon dioxide layer with a thickness of about 3500 angstroms. Structure 526, including this insulating layer, is thereafter heated to a temperature of about 920° C. in the presence of nitrogen gas ($N_2$) flowing at a rate of about 10 SLM for approximately 25 minutes. Heating silicon dioxide at this temperature causes densification (i.e., the oxide thickness decreases and density increases) of the insulating layer.

Thereafter, a polysilicon layer is deposited over the insulating layer through, for example, conventional chemical vapor deposition processes. The resulting polysilicon layer (which will ultimately form extraction structure 132 of FIG. 1) is doped with phosphorous to achieve conductivity. More specifically, this polysilicon layer, the underlying insulating layer and structure 526 (FIG. 5D) are heated to a temperature of approximately 965° C. in the presence of nitrogen (flowing at about 15 SLM), oxygen (flowing at about 230 SCCM) and phosphine ($PH_3$; flowing at about 375 SCCM) for about 30 minutes thereby doping the polysilicon layer by diffusion.

Ion implantation, silicon dioxide deposition and polysilicon doping and deposition are described in greater detail in S. M. Sze, *VLSI Technology* (Second Edition), McGraw-Hill, Inc. (1988), which is hereby incorporated by reference in its entirety for all purposes. A more detailed discussion of FED fabrication processes may be found in U.S. Pat. No. 5,372,973.

In the course of carrying out the foregoing conventional MOSFET and FED fabrication steps (i.e., pursuant to blocks 415 and 416), the underlying gate oxide(s) (e.g., gate oxide 514) are subject to sufficient heat (via a furnace) to constitute an annealing process. As described above, process temperatures as high as 920° C. (for about 25 minutes), 965° C. (for about 30 minutes) and 1032° C. (for about 60 minutes) are used in the foregoing fabrication steps. These steps subject the gate oxide to a temperature of at least 900° C. and more specifically to a range of approximately 900–1000° C. for at least about 100 minutes. The net effect of this process is twofold.

First, gate oxide annealing returns the previously-shifted threshold voltage(s) of the subject device(s) to near-normal values. As mentioned above, $V_t$ is shifted as a result of the nitride oxidation step in block 408 of FIG. 4. If a furnace process is used, the $V_t$ is shifted downward relatively uniformly across a subject wafer. As such, annealing will recover much of this $V_t$ shift also in a relatively uniform manner. Specifically, if the $V_t$ was initially shifted from about 0.6 volts to about 0.2 volts, then a uniform recovery to about 0.5 volts across the subject wafer will be attainable.

Conversely, if RTP is used to carry out the nitride oxidation step, the $V_t$ is shifted downward over a range of values throughout the subject wafer. Accordingly, if the $V_t$ was initially shifted from about 0.6 volts to about 0.2–0.4 volts, then a recovery to about 0.4–0.5 volts across the subject wafer will be attainable. (Such non-uniform variation in $V_t$ is yet another reason why furnace processing is preferred over RTP in the nitride oxidation step described above.)

The second benefit achieved from annealing is the distribution of nitrogen within nitride oxidation layer 509 (FIG. 5D). Specifically, the high temperatures experienced in the steps of blocks 415 and 416 will anneal structure 526 resulting in a relatively uniform distribution of nitrogen throughout layer 509. Such distribution creates a more uniform $V_t$ for all MOSFETs on the subject wafer which, in turn, produces a relatively uniform screen brightness in FEDs (i.e., minimizes bright spots). This is a critical parameter for successful FED operation.

Figure 7:
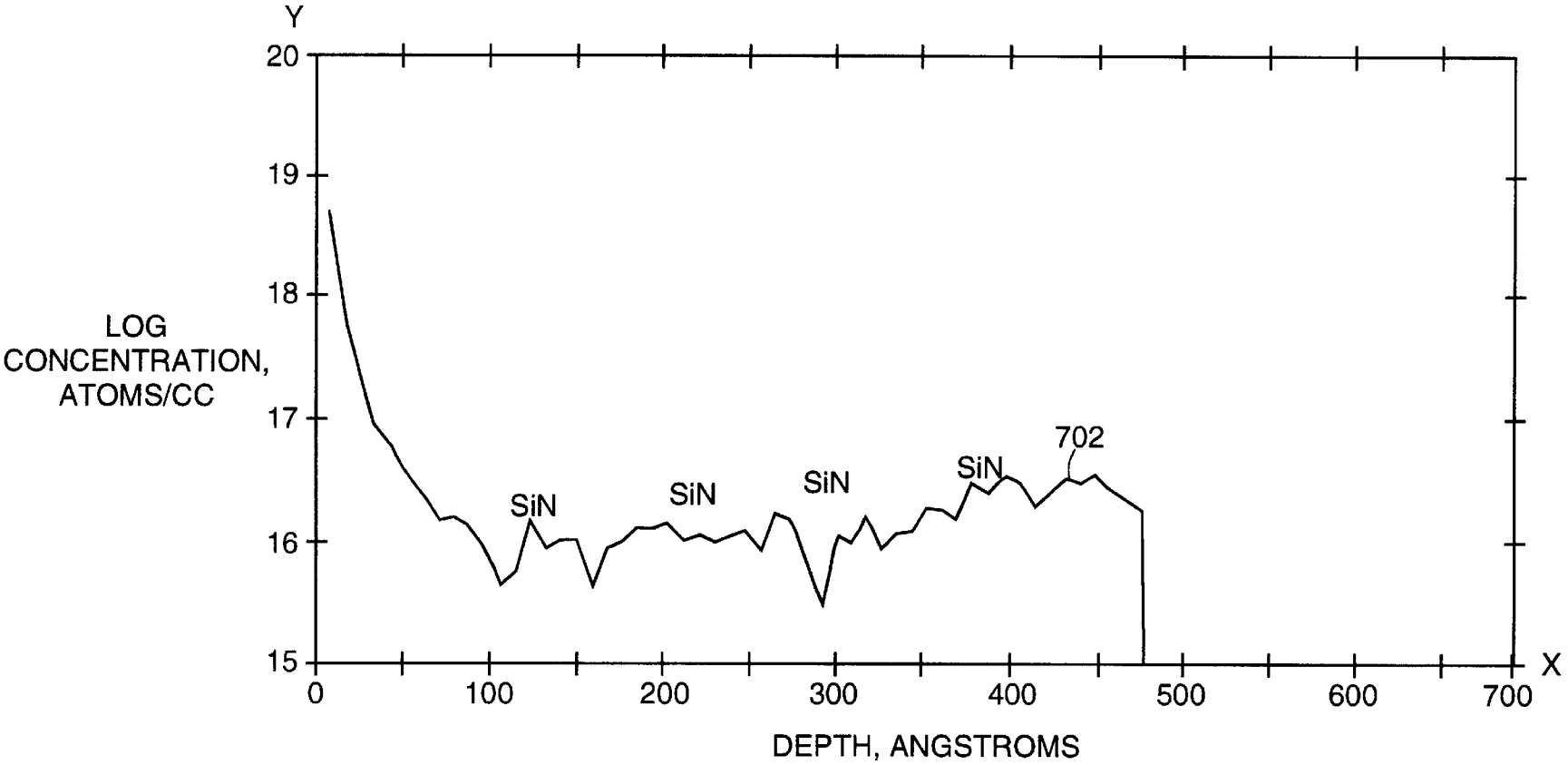
FIG. 7 is a secondary ion mass spectrometry (SIMS) depth profile of a control test structure showing relative SiN concentration.
Figure 8:
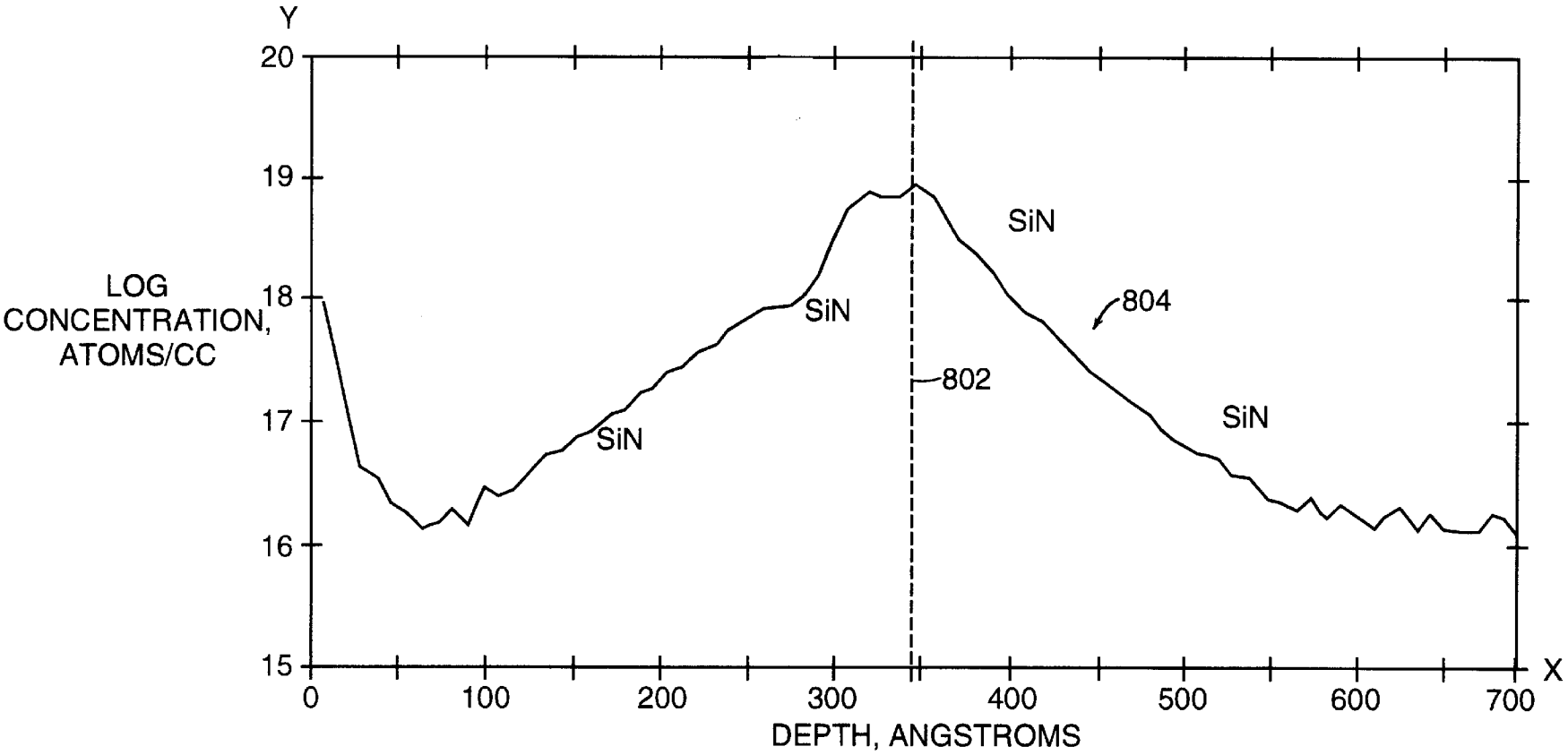
FIG. 8 is a SIMS depth profiles of a $N_2O$-treated test structure showing relative SiN concentration.
Figure 9A:
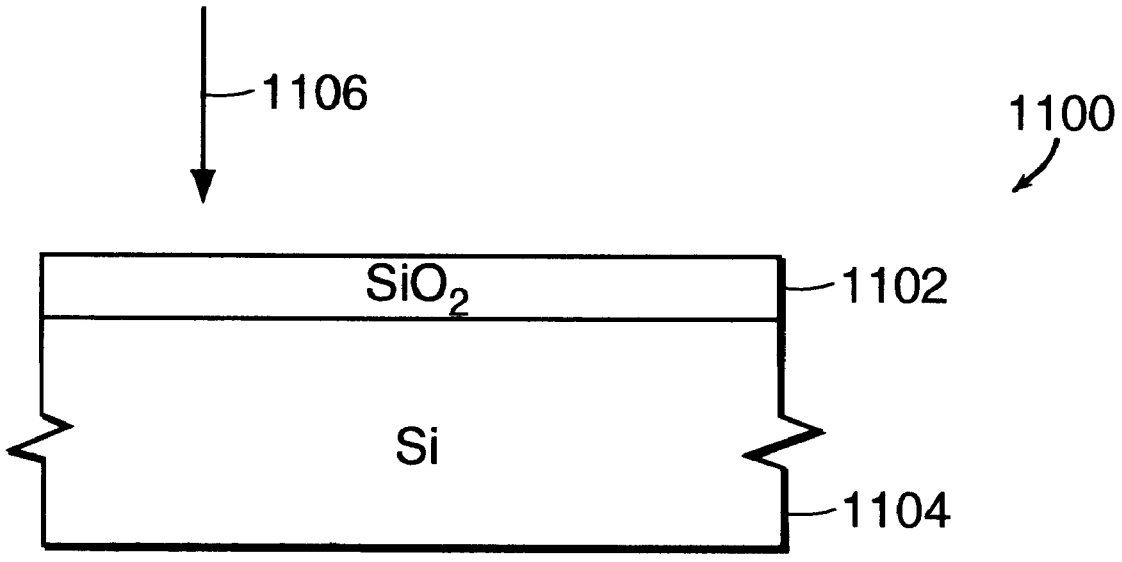
FIGS. 9*a* and 9*b* are cross-sectional views of portions of model test structures.
Figure 9B:
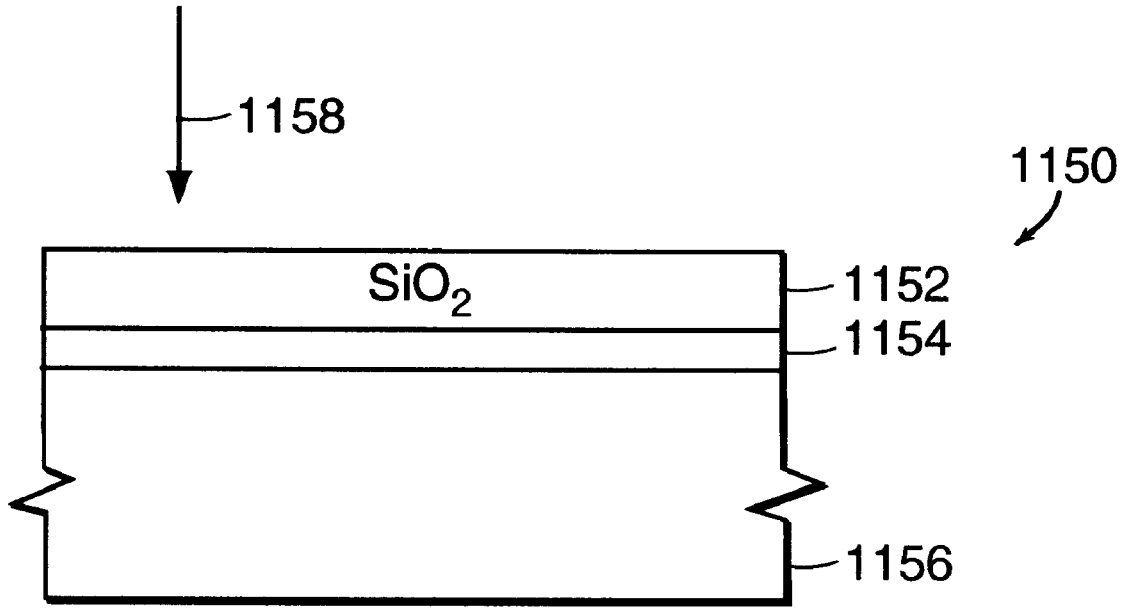

Distribution of nitrogen in a nitride oxidation layer, such as layer 509, is exemplified by the sample measurements shown in the graphs of FIGS. 7–8 These graphs represent secondary ion mass spectrometry (SIMS) depth profiles of portions of test structures constructed pursuant to model test structure 1100 of FIG. 9*a* (i.e., including a silicon dioxide layer 1102 disposed atop a silicon substrate 1104) or model test structure 1150 of FIG. 9*b* (i.e., including a silicon dioxide layer 1152 disposed atop a nitride oxidation layer 1154 which is, in turn, disposed atop a silicon substrate 1156).

The values graphed in FIGS. 7 and 8 are for comparison purposes only and are not to be interpreted as quantitative. The y-axes of graphs in FIGS. 7 and 8 are logarithmic in scale and represent concentrations of silicon-nitrogen molecules (SiN) in atoms per cubic centimeter (atoms/cc). The x axes of graphs in these figures represent depth in a vertical direction (as illustrated by arrows 1106 and 1158 of FIGS. 9*a* and 9*b*) from the top of silicon dioxide layers 1102 or 1152. (Due to measurement abnormalities associated with the surfaces of layers 1102 and 1152, values given for the first 50 angstroms in depth for FIGS. 7 and 8 should be ignored.) FIG. 7 illustrates relative SiN concentrations in a control test structure; i.e., a test structure untreated with $N_2O$. The test structure is constructed from a silicon dioxide layer that is approximately 350 angstroms thick and disposed atop a silicon substrate in accordance with model test structure 1100. As shown in FIG. 7, the reported concentration of SiN is relatively constant from approximately 100 to 475 angstroms in depth from the surface of the silicon dioxide layer. (The vertical line at about 475 angstroms represents termination of measurement.)

FIG. 8 illustrates relative SiN concentrations in a "treated" test structure; i.e., a test structure subject to 90 minutes of $N_2O$ gas at approximately 957° C. under atmospheric pressure and annealed for approximately 100 minutes at about 900–1000° C. The resulting treated test structure includes a silicon dioxide layer that is approximately 310 angstroms thick and disposed atop a nitride oxidation layer approximately 40 angstroms thick which is, in turn, disposed atop a silicon substrate in accordance with model test structure 1150. As shown in FIG. 8, the relative concentration of silicon-nitrogen has increased significantly. Line 802 in this figure represents the gate-oxide/Si interface; accordingly, the right side of this line represents silicon substrate and the left side represents gate oxide. The nitride oxidation layer is generally the region of the gate-oxide formed in the presence of a nitrogen-based substance (i.e., $N_2O$ gas) and containing the highest concentration (in atoms per cubic centimeter) of silicon-nitrogen. Referring to the graph in FIG. 8, the nitride oxidation layer is disposed between approximately 300 and 340 angstroms below the surface of the gate oxide. The actual SiN concentration in this region is the difference between the values in FIGS. 7 and 8. For example, peak SiN concentrations at the gate-oxide/Si interfaces for the structures of FIGS. 7 and 8 were measured at $4.10\times10^{16}$ and $9.10\times10^{18}$ atoms/cc , respectively. The difference between these values (i.e., $8.96\times10^{18}$) represents the approximate actual peak concentration of SiN in the treated test structure.

Referring to FIG. 8, the portion of line 804 representing concentration values for depths between about 340 angstroms (i.e., line 802) and about 575 angstroms is erroneously high and should be ignored. This error is a product of the measuring equipment, which discharges a peak measurement value at a lower rate than the actual drop off in concentration in the subject test structure. (In fact, there is essentially no SiN present to the right of line 802 because nitrogen cannot penetrate the silicon substrate.) Accordingly, line 804 does not represent accurate relative values after about the 340 angstrom mark until it "catches up" with the data at about the 575 angstrom mark.

In addition to the foregoing SIMS analysis, XPS (X-ray Photoelectron Spectroscopy) analysis has been performed on a "treated" test structure (i.e., treated with $N_2O$ and an annealing process as described above). This structure includes a 500-angstrom-thick gate oxide (with a silicon dioxide layer and a nitride oxide layer) disposed atop a silicon substrate. This XPS analysis identified a nitrogen concentration of about 1.32% exclusively at the interface region between the gate oxide and silicon substrate; i.e., the nitride oxidation layer The foregoing SIMS and XPS analyses illustrate the creation of a nitride oxidation layer at the interface between a silicon dioxide layer and a silicon substrate (which replicates a gate oxide/Si interface) after this structure had been subjected to $N_2O$ gas and an anneal process comparable to that described above for structure 526 in FIG. 5D. Accordingly, the treated MOSFET in the micropoint switch of the present invention includes a nitride oxidation region or layer within the gate oxide that contains the maximum concentration (in atoms per cubic centimeter) of SiN within the gate oxide.

Preferably, the foregoing nitride oxidation process is carried out using $N_2O$ gas. However, other nitrogen-based gas may also be used, including $NH_3$ which provides an alternative source of nitrogen atoms to carry out the nitride oxidation process described above pursuant to the parameter of Tables 3 and 4 below.

As shown in tables 1–4 below, the process parameters associated with $N_2O$ and $NH_3$ for the disclosed process are essentially the same. (The values provided in Tables 1–4 are approximations. "N/A" means not applicable; i.e., the parameter has essentially no effect on the corresponding process.) However, because the $NH_3$ gas contains hydrogen atoms, an additional "reoxidation" step must be carried out pursuant to the parameters set out in Tables 3 and 4. This step, which is performed during the FED fabrication step identified in block 408 of FIG. 4 and discussed in greater detail below, eliminates a certain amount of hydrogen from the gate oxide and creates an additional layer of silicon dioxide (approximately 40 angstroms thick) under the nitride oxidation layer. Referring to the process of FIG. 4, only block 408 is altered when $NH_3$ gas is used in the formation of the nitride oxidation layer. All remaining blocks (i.e., blocks 402–406 and 412–416) are the same as described above.

TABLE 1

| | Form $SiO_2$ Layer | | Form Nitride Oxidation Layer (Furnace) | Anneal |
|---|---|---|---|---|
| Gas | Dry $O_2$ | Dry $O_2$ and TLC | $N_2O$ | N/A |
| Pressure | atmospheric | atmospheric | atmospheric | N/A |
| Temperature | 957° C. | 957° C. | 957° C. | 900–1000° C. |
| Time | 18 minutes | 18 minutes | 100 minutes | 100 minutes |

TABLE 2

| | Form $SiO_2$ Layer | | Form Nitride Oxidation Layer (RTP) | Anneal |
|---|---|---|---|---|
| Gas | Dry $O_2$ | Dry $O_2$ and TLC | $N_2O$ | N/A |
| Pressure | atmospheric | atmospheric | atmospheric | N/A |
| Temperature | 957° C. | 957° C. | 1000° C. | 900–1000° C. |
| Time | 18 minutes | 18 minutes | 120 seconds | 100 minutes |

TABLE 3

| | Form $SiO_2$ Layer | | Form Nitride Oxidation Layer (Furnace) | Reoxidation (Furnace) | Anneal |
|---|---|---|---|---|---|
| Gas | Dry $O_2$ | Dry $O_2$ and TLC | $NH_3$ | Dry $O_2$ | N/A |
| Pressure | atmospheric | atmospheric | atmospheric | atmospheric | N/A |
| Temperature | 957° C. | 957° C. | 957° C. | 1000° C. | 900–1000° C. |
| Time | 18 minutes | 18 minutes | 100 minutes | 30 minutes | 100 minutes |

TABLE 4

| | Form $SiO_2$ Layer | | Form Nitride Oxidation Layer (RTP) | Reoxidation (RTP) | Anneal |
|---|---|---|---|---|---|
| Gas | Dry $O_2$ | Dry $O_2$ and TLC | $NH_3$ | Dry $O_2$ | N/A |
| Pressure | atmospheric | atmospheric | atmospheric | atmospheric | N/A |
| Temperature | 957° C. | 957° C. | 1000° C. | 1000° C. | 900–1000° C. |
| Time | 18 minutes | 18 minutes | 120 seconds | 120 seconds | 100 minutes |

Turning to block 408 of FIG. 4 with regard to the use of $NH_3$, a two-step process is required: first a nitride oxidation layer is formed at the gate-oxide/Si interface 503 (of structure 522 in FIG. 5B), and second a $SiO_2$ layer is grown beneath the nitride oxidation layer. This process is carried out by heating structure 522 of FIG. 5B in the presence of $NH_3$ gas at atmospheric pressure. As with $N_2O$, the nitride oxidation process may be performed preferably in a furnace or, alternatively, using RTP. Furnace treatment subjects interface 503 to a temperature of about 957° C. for approximately 100 minutes. Alternatively, RTP processing subjects the interface to a temperature of about 1000° C. for approximately 120 seconds. A nitride oxidation layer 509 disposed at the gate-oxide/Si interface 503 is illustrated in structure 524 of FIG. 5C.

Following the formation of layer 509, the structure 524 is subject to reoxidation in accordance with the parameters set out in Tables 3 and 4. If layer 509 were formed with a furnace, reoxidation may also be carried out with a furnace (pursuant to Table 3) or RTP (pursuant to Table 4). Similarly, if RTP were used to form layer 509, reoxidation may be carried out with RTP (pursuant to Table 4) or a furnace (pursuant to Table 3). During reoxidation, a second silicon dioxide layer 602 (FIG. 6) is grown in dry $O_2$ beneath nitride oxidation layer 509 in atmospheric pressure at a temperature and time as set out in Table 3 (furnace) or Table 4 (RTP).

Figure 5C:
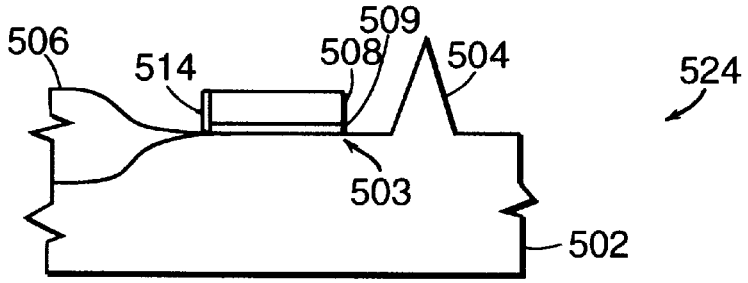
Figure 5D:
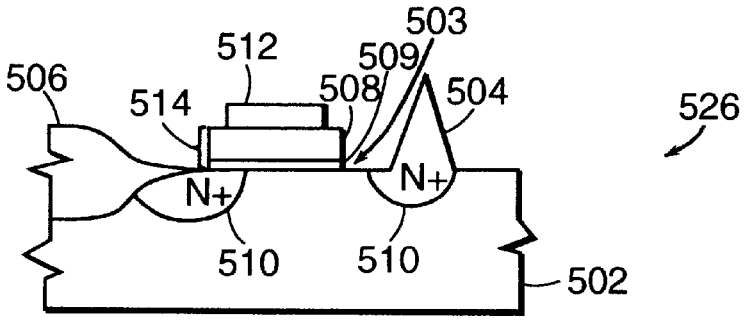
Figure 6:
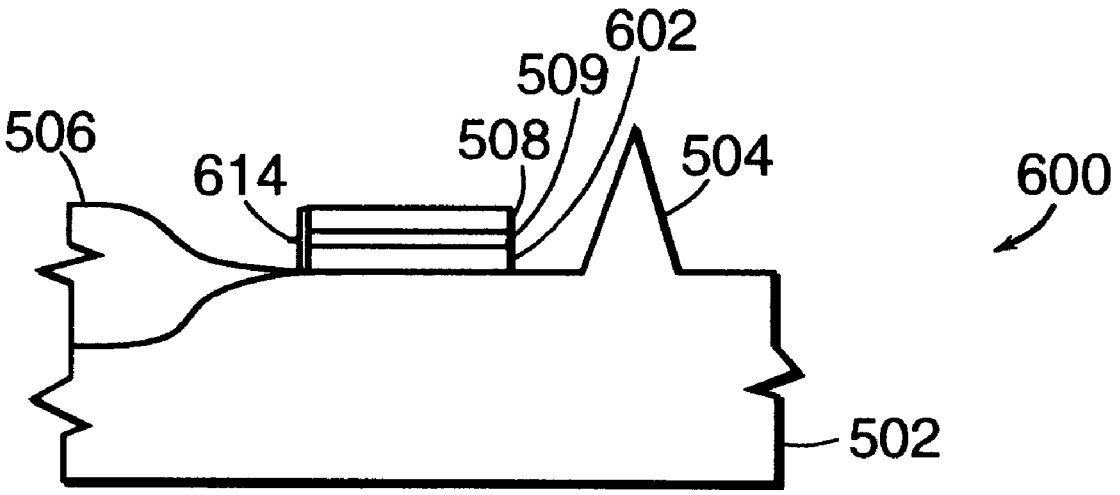

The stack of layers 508, 509 and 602 in FIG. 6 constitute gate oxide 614, which is treated like gate oxide 514 in FIG. 5C for the remaining steps of FED fabrication as set out in chart 400 of FIG. 4.

Alternative processes for forming a nitride oxidation layer in gate oxides of various thicknesses which can be used in the formation of FEDs may be found in the following publications, each of which is incorporated by reference in its entirety for all purposes: G. J. Dunn, et al., "Radiation Effects in Low-Pressure Reoxidized Nitrided Oxide Gate Dielectrics," *Appl. Phys. Lett.* 52 (20), pp. 1713–1715 (May 1988), Viju K. Matthews, et al., "Degradation of Junction Leakage in Devices Subjected to Gate Oxidation in Nitrous Oxide," *IEEE Electron Device Lett.,* Vol. 13, No. 12, pp. 648–650 (Dec. 1992), and C. Lai, et al., "Post-Polysilicon Gate-Process-Induced Degradation on Thin Gate Oxide," *IEEE Electron Device Lett.,* Vol. 16, No. 11, pp. 470–471 (November 1995).

The invention has now been described in terms of the foregoing embodiments with variations. Modifications and substitutions will now be apparent to persons of ordinary skill in the art. Accordingly, it is not intended that the invention be limited except as provided by the appended claims.

What is claimed is:

1. A micropoint assembly comprising:

a micropoint; and a MOSFET coupled to said micropoint and operable to activate and deactivate said micropoint, said MOSFET comprising a substrate and a nitride oxidation layer disposed adjacent to said substrate.

2. The micropoint assembly of claim 1 further comprising a gate oxide, said nitride oxidation layer being disposed within said gate oxide.

3. The micropoint assembly of claim 2 wherein said nitride oxidation layer has a maximum concentration in atoms per cubic centimeter of SiN within said gate oxide.

4. The micropoint assembly of claim 3 wherein said gate oxide is greater than 300 angstroms thick.

5. A field emission device comprising:

a cathodoluminescent screen;

a plurality of micropoints disposed proximate to said screen, said micropoints enabling the emission of electrons toward said screen when activated and stopping such emission when deactivated; and a first switch coupled to said micropoints, said first switch containing a first nitride oxidation layer and being capable of deactivating said plurality of micropoints.

6. The field emission device of claim 5 further comprising a second switch coupled to said first switch, said second switch containing a second nitride oxidation layer and being capable of deactivating said plurality of micropoints.

7. The field emission device of claim 6 wherein said first and second switches are MOSFETs which together are capable of activating said plurality of micropoints.

8. The field emission device of claim 7 wherein said plurality of micropoints are disposed in an array comprising a plurality of rows and columns of micropoints and said first switch is controlled by a column line signal and said second switch is controlled by a row line signal.

9. The field emission device of claim 7 wherein each of said first and second switches includes a gate oxide, said gate oxide having a thickness greater than 300 angstroms and said first and second nitride oxidation layers being disposed within said gate oxide of said first and second switches, respectively.

10. A method for constructing a micropoint assembly comprising the steps of:

forming a micropoint; and forming a switch coupled to said micropoint for activating and deactivating said micropoint including the steps of:

forming a first layer of silicon dioxide disposed proximate to said micropoint;

forming a nitride oxidation layer beneath said first layer in the presence of a nitrogen-based substance; and annealing said nitride oxidation layer.

11. The method of claim 10 wherein said nitrogen-based substance is $N_2O$.

12. The method of claim 11 wherein said gate forming step includes growing gate oxide in dry $O_2$.

13. The method of claim 12 wherein said step of forming a nitride oxidation layer is performed in a furnace at a temperature of about 900° C. to 1100° C. for approximately 20 to 150 minutes.

14. The method of claim 13 wherein said step of forming a nitride oxidation layer is performed using a rapid thermal process at a temperature of about 950° C. to 1100° C. for approximately 120 seconds.

15. The method of claim 10 further comprising the steps of:

forming a second layer of silicon dioxide beneath said nitride oxidation layer through reoxidation; and doping a polysilicon layer simultaneously with said annealing step, said polysilicon layer being used to form an extraction structure.

16. The method of claim 15 wherein said nitrogen-based substance is $NH_3$.

17. A field emission device comprising:

a cathodoluminescent screen;

a plurality of micropoints disposed proximate to said screen, said micropoints enabling the emission of electrons toward said screen when activated and stopping such emission when deactivated;

a first MOSFET coupled to said micropoints, said first MOSFET containing a first gate oxide having a thickness greater than 300 angstroms and a first nitride oxidation layer disposed within said first gate oxide, said first MOSFET being capable of deactivating said plurality of micropoints; and a second MOSFET coupled to said first MOSFET, said second MOSFET containing a second gate oxide having a thickness greater than 300 angstroms and a second nitride oxidation layer disposed within said second gate oxide, said second MOSFET being capable of deactivating said plurality of micropoints.

18. A display comprising:

an anode;

a cathode disposed proximate to said anode and operable to emit electrons toward said anode; and a first switch coupled to said cathode, said first switch containing a first nitride oxidation layer and being operable to activate and deactivate said cathode.

19. The display of claim 18 further comprising a second switch coupled to said first switch, said second switch containing a second nitride oxidation layer and being operable to activate and deactivate said cathode.

20. The display of claim 19 wherein said first and second switches are MOSFETs, each of said first and second switches including a gate oxide, said gate oxide having a thickness greater than 300 angstroms and said first and second nitride oxidation layers being disposed within said gate oxide of said first and second switches, respectively.

21. A method for constructing a field emission device comprising the steps of:

forming a plurality of micropoints;

forming a plurality of switches coupled to said plurality of micropoints, said plurality of switches being operable to activate and deactivate said micropoints, said switches forming step including the steps of:

forming a layer of silicon dioxide disposed proximate to each of said plurality of micropoints;

forming a nitride oxidation layer beneath said layer of silicon dioxide in the presence of a nitrogen-based substance; and annealing said nitride oxidation layer; and doping a polysilicon layer disposed proximate to said micropoints simultaneously with said annealing step, said polysilicon layer being used to form an extraction structure.

22. The method of claim 21 wherein said nitrogen-based substance is $N_2O$.

23. A display comprising:

an anode;

a cathode disposed proximate to said anode and operable to emit electrons toward said anode;

a first switch coupled to said cathode, said first switch containing a first nitride oxidation layer and being operable to activate and deactivate said cathode said first nitride oxidation layer being approximately 30 to 40 angstroms thick; and a second switch coupled to said first switch, said second switch containing a second nitride oxidation layer and being operable to activate and deactivate said cathode, said second nitride oxidation layer being approximately 30 to 40 angstroms thick.

24. A method for constructing a field emission device comprising the steps of:

forming a plurality of micropoints;

forming a plurality of MOSFETs coupled to said plurality of micropoints, said plurality of MOSFETs being operable to activate and deactivate said micropoints, said MOSFETs forming step including the steps of:

forming a layer of silicon dioxide disposed proximate to each of said plurality of micropoints;

forming a nitride oxidation layer beneath said layer of silicon dioxide in the presence of $N_2O$;

forming a layer of doped polysilicon over said layer of silicon dioxide;

forming source/drain regions beneath said nitride oxidation layer; and annealing said nitride oxidation layer; and doping a polysilicon layer disposed proximate to said micropoints simultaneously with said annealing step, said polysilicon layer being used to form an extraction structure.

25. A method for constructing a field emission device comprising the steps of:

forming a plurality of micropoints;

forming a plurality of MOSFETs coupled to said plurality of micropoints, said plurality of MOSFETs being operable to activate and deactivate said micropoints, said MOSFETs forming step including the steps of:

growing a layer of silicon dioxide in the presence of dry $O_2$ under atmospheric pressure;

forming a nitride oxidation layer beneath said layer of silicon dioxide in the presence of $N_2O$;

forming a layer of doped polysilicon over said layer of silicon dioxide;

forming source/drain regions beneath said nitride oxidation layer; and annealing said nitride oxidation layer; and doping a polysilicon layer disposed proximate to said micropoints in the presence of nitrogen, phosphine and oxygen for about 30 minutes at a temperature of about 965° C. simultaneously with said annealing step, said polysilicon layer being used to form an extraction structure.

26. A field emission display including:

a phosphor coated screen;

a cathode disposed proximal said phosphor coated screen, said cathode including, a plurality of micropoints, each of said micropoints being operable in an active state for emitting electrons towards said screen and in an inactive state for substantially preventing emission of electrons towards said screen, a first MOSFET characterized by a threshold voltage and having a gate, a source, and a drain, said first MOSFET drain being electrically coupled to at least one of said micropoints, said first MOSFET source being electrically coupled to a reference potential, said first MOSFET gate including a nitride oxidation layer, said first MOSFET gate being electrically coupled to receive a first control signal, said first MOSFET establishing a relatively low resistance path between said first MOSFET drain and source in response to a value of said first control signal lower than said threshold voltage and thereby controlling said at least one micropoint to operate in said active state, said first MOSFET establishing a relatively high resistance path between said first MOSFET drain and source in response to a value of said first control signal higher than said threshold voltage and thereby controlling said at least one micropoint to operate in said inactive state.

27. A display according to claim 26, said first MOSFET including a gate oxide, said nitride oxidation layer being disposed within said gate oxide.

28. A display according to claim 26, wherein said nitride oxidation layer is at least 15 Angstroms thick.

29. A display according to claim 26, further including a second MOSFET including a gate, a source, and a drain, said second MOSFET gate being electrically coupled to receive a second control signal, said second MOSFET source being electrically coupled to said first MOSFET drain between said first MOSFET drain and said at least one micropoint, said second MOSFET drain being electrically coupled to said at least one micropoint.

30. A display according to claim 26, said second MOSFET gate including a nitride oxidation layer.

31. A display according to claim 30, said second MOSFET gate including a gate oxide, said nitride oxidation layer being disposed within said gate oxide.

* * * * *